US011724919B2

(12) United States Patent
Kalanj et al.

(10) Patent No.: US 11,724,919 B2
(45) Date of Patent: Aug. 15, 2023

(54) SYSTEM FOR REPOSITIONING A CRANE

(71) Applicant: FAVELLE FAVCO BERHAD, Selangor (MY)

(72) Inventors: Ljubomir Kalanj, Mt. Pritchard (AU); Pang Ong Tuan, Mascot (AU); Nathan Vella, Mollymook Beach (AU); Shenandoah Chong, Newington (AU); John Patrick Dawson, Canterbury (AU)

(73) Assignee: FAVELLE FAVCO BERHAD, Selangor (MY)

( * ) Notice: Subject to any disclaimer, the term of this patent is extended or adjusted under 35 U.S.C. 154(b) by 317 days.

(21) Appl. No.: 17/203,248

(22) Filed: Mar. 16, 2021

(65) Prior Publication Data

US 2021/0292134 A1 Sep. 23, 2021

(30) Foreign Application Priority Data

Mar. 17, 2020 (MY) ..... 2020001491

(51) Int. Cl.
*B66C 23/32* (2006.01)
*B66C 23/28* (2006.01)

(52) U.S. Cl.
CPC ..... *B66C 23/32* (2013.01); *B66C 23/283* (2013.01)

(58) Field of Classification Search
CPC ..... B66C 23/32; B66C 23/283; B66C 23/207; B66C 23/28
See application file for complete search history.

(56) References Cited

U.S. PATENT DOCUMENTS 7,290,672 B2 11/2007 Davis et al.

FOREIGN PATENT DOCUMENTS

JP 2008063118 A 3/2008

*Primary Examiner* — Sang K Kim
*Assistant Examiner* — Nathaniel L Adams
(74) *Attorney, Agent, or Firm* — Muncy, Geissler, Olds & Lowe P.C.

(57) ABSTRACT

A system for repositioning at least one crane superposed on a tower positioned within a bay of a building structure includes a supporting structure positioned within the bay of the building structure arranged surrounding the tower having a plurality of a repositionable support braces, at least one supporting platform reversibly mounted to the tower by a plurality of support hooks, a ladder vertically suspended from the supporting platform adapted as a track and a main platform adapted to carry and reposition the tower comprises at least one first lifting means configured to reversibly extend the main platform, at least a first climbing means and a second climbing means reversibly engageable to the ladder.

45 Claims, 16 Drawing Sheets

SYSTEM FOR REPOSITIONING A CRANE

FIELD OF THE INVENTION

The present invention relates to a device for facilitating climbing of a crane. More particularly, the present invention relates to a device for facilitating climbing of a crane tower through an opening of a building under construction.

BACKGROUND OF THE INVENTION

In construction, it is not possible to build modern tall buildings without tower cranes that can elevate as the height of the building is increased. Two of the most common methods used to elevate a tower crane in building construction sites are external climbing and internal climbing methods. In external climbing elevation method, the tower crane is configured to grow upwards along the outside of the building. On the other hand, internal climbing elevation method is performed to elevate the tower crane from within the building under construction by climbing off internal structure of the building.

The tower cranes are often used in construction sites to transport and hoist construction materials from one place to another within its reach. Tower cranes typically include a base, a tower, and a crane. The base is connected to a concrete foundation and supports tower. The tower, on the other hand, is typically bolted to the base to provide heights to the crane, which is normally attached to the top of the tower via a slewing bearing.

The internal climbing method of elevating tower cranes is particularly used to elevate tower cranes located within a bay of a building. As the building height increases, there will be a need to increase the height of the crane, which therefore leads to a need to use the internal climbing method for a tower crane that is positioned within the bay of the building. The tower crane is typically disconnected from the concrete foundation prior to the first elevation of the tower crane.

In order to allow the operation and climbing of the tower crane, typically, sets of supports comprising steel beams and steel brackets are required to be fixed to the nearby building structures to support and restrain the tower of the tower crane. Without sufficient fixed support, the stability of the tower crane will be compromised, therefore posing a safety threat to the people within the construction site and surrounding areas. Hence, the tower crane elevation process typically utilizes the sets of supports during elevation process.

There are several existing internal tower crane climbing methods; one of the methods involves preinstalling external jacking means and support apparatus to the floor of the building structure. In order for this method to work, the tower has to fit tightly and precisely to the building structure. The support system has to be adequately sized in order to maintain stability of the tower crane and to accept operational loads induced by the crane. One strategy employable to improve stability of the tower crane during internal climbing of a tower crane is by improving the design of the vertical tower so that the tower design conforms to the requirements of a building structure.

Further, as more and more buildings are starting to possess more complex designs, there will be more need to perform internal climbing of a tower crane with reduced in contact between the tower crane and the building, while providing strong support to the tower crane during the elevation process.

Several prior arts exist with the abovementioned issues.

Japanese patent publication no. JP2008063118 (A) discloses a crane building floor climbing system installed on a framework capable of ascending and descending the said floor, comprises a frame, a ladder, a telescopic outrigger that is horizontally rotatable, and a plurality of vertical frames. The crane building floor climbing system however is aimed to be rigid and lacks flexibility in order to increase stability of the structure. Further, the frame of the Japanese patent publication is installed in very close proximity with the building structure.

United States publication number U.S. Pat. No. 7,290,672 B2 discloses a device for lifting a tower crane comprising a lower basket, an upper basket, and a climbing frame above the upper basket. The upper basket and the lower basket include a plurality of foot members which can be extended to rest on the support stubs of the vertical columns of the building structure. The upper basket and the climbing frame can slide in relation to the tower connected by hydraulic cylinder, while the lower basket is attached to the base of the tower. The device, however, requires reconfigurations to its components whenever a need arise to use the device to accommodate buildings with different opening sizes.

A need therefore exists for a system to reposition a crane that is more flexible, yet strong, thereby overcoming the problems and shortcomings of the prior art. Although there are many apparatuses for the same in the prior art, for many practical purposes, there is still considerable room for improvements.

SUMMARY OF THE INVENTION

The following presents a summary of the invention in order to provide a basic understanding of some aspects of the invention. This summary is not an extensive overview of the invention. Its sole purpose is to present some concepts of the invention in a simplified form as a prelude to the more detailed description that is presented later.

Accordingly, an embodiment of the present invention provides a system (100) for repositioning at least one crane superposed on a tower positioned within a bay of a building structure surrounded by a supporting structure having a plurality of repositionable support brackets. The system comprises at least one supporting platform reversibly mounted to the tower by a plurality of support hooks, a ladder vertically suspended from the supporting platform adapted as a track; and a main platform adapted to carry and reposition the tower comprises at least one first lifting means configured to reversibly extend the main platform, at least a first climbing means and a second climbing means reversibly engageable to the ladder.

The main platform is configured to reposition the tower by engaging the first climbing means to the climbing ladder, extending the main platform with the first lifting means, engaging the second climbing means to the ladder, disengaging the first climbing means from the climbing ladder, and retracting the main platform by the first lifting means, consequently repositioning the tower along the climbing ladder to reposition at least one crane.

Preferably, the main platform or both the main platform and the supporting platform further comprising a lateral supporting means. The lateral supporting means comprises a plurality of retractable outrigger arms extending from the main platform or the main platform and the supporting platform adapted to reversibly connect to the supporting structure. The plurality of outrigger arms are preferably rotatable with respect to the main platform or the main platform and the supporting platform.

In accordance to an embodiment of the present invention, each of the outrigger arms are connected to the main platform or the main platform and the supporting platform by a pin adapted to be rotatable at an axis with respect to the pin. Preferably, each of the outrigger arms comprises an outrigger beam extendable from an outrigger housing connected to the main platform or the main platform and the supporting platform by the pin. Further, each of the outrigger arms is configured to be telescopically extendable from the outrigger housing by at least one hydraulic cylinder.

In accordance to yet another embodiment of the present invention, each of the outrigger arms further comprises a horizontal brace and a vertical brace extending from the main platform or the main platform and the supporting platform to the outrigger housing.

According to an embodiment of the present invention, each of the outrigger arms further comprises a connecting point at an end of the outrigger beam reversibly connectible to the supporting structure by the repositionable support brackets.

Preferably, the outrigger arms of the supporting platform are adapted to be extended and connected to the supporting structure during tower repositioning.

According to an embodiment of the present invention, the supporting platform comprises a first section and a second section connected by at least one lifting means. Preferably, the plurality of support hooks are configured to the first section and the second section. In an embodiment, the first section and the second section are reversibly mounted to the tower by connecting the plurality of support hooks to the tower. Preferably, the plurality of support hooks are disconnected from the tower during tower repositioning.

Preferably, the second section of the supporting platform comprises a guide to maintain Z-axis stability of the tower during tower repositioning. The guide comprises at least one adjustable clamp block adapted to be in proximity with the tower during tower repositioning to maintain Z-axis stability of the tower.

Preferably, the climbing ladder comprises a plurality of rungs and is rotatable at about the X-axis and Y-axis with respect to the supporting platform. The climbing ladder is preferably attached to the supporting platform by a lug and at least one connector.

In accordance to an embodiment of the present invention, the main platform further comprising a first assembly and a second assembly connected by the first lifting means. In an embodiment, the first assembly is adapted to support the tower during repositioning of the tower. On the other hand, the second assembly is secured to the tower adapted to carry the weight of the tower. Preferably, the main platform is adapted to extend by extending the first lifting means for elevating the second assembly away from the first assembly or lowering the first assembly away from the second assembly.

In accordance to an embodiment of the present invention, the main platform is adapted to retract by retracting the first lifting means for elevating the first assembly towards the second assembly or lowering the second assembly and the tower towards the first assembly.

Preferably, the first climbing means and the second climbing means comprise a plurality of hooks pivotally connected to the first assembly and second assembly respectively.

In accordance to an embodiment of the present invention, the outrigger arms are configured to be extended from the second assembly adapted to reversibly connect to the supporting structure. In an embodiment of the present invention, the outrigger arms are adapted to be retracted for detaching the outrigger arms from the supporting structure during tower repositioning.

Preferably, the first climbing means is adapted to latch to the rungs of the ladder during extension of the main platform. Next, the second climbing means is adapted to latch to the rungs of the ladder after the main platform is extended.

Preferably, the first climbing means is configured to unlatch from the rungs of the ladder prior to retraction of the main platform by pulling the first assembly towards the second assembly.

Preferably, the extension and retraction of the main platform are configured to be repeatable to reposition the tower to a height along the structural support and limited by height of the structural support.

Preferably, the outrigger arms are configured to extend towards the supporting structure to connect the main platform to the supporting structure after repositioning is complete.

Preferably, the first climbing means and the second climbing means are configured to disconnect from the ladder when repositioning is complete.

In another embodiment of the present invention, the lateral supporting means comprises at least two outrigger arms.

Preferably, the plurality of support hooks are reversibly rotatable by a pivot to reversibly hook the supporting platform to the tower.

In accordance to an embodiment of the present invention, the supporting platform is configured to be repositionable along the tower.

In accordance to an embodiment of the present invention, the supporting platform is configured to be reversibly extendable.

Preferably, the supporting platform is repositionable along the tower by rotating the plurality of support hooks of the first section to disconnect the plurality of support hooks from the tower, extending the second lifting means to extend the supporting platform to reposition the first section at a desired height, reconnecting the plurality of support hooks of the first section to the tower, disconnecting the plurality of support hooks of the second section, and retracting the second lifting means to reposition the second section of the supporting platform, thereby repositioning the supporting platform. The outrigger arms are retracted during the repositioning of the supporting platform.

Preferably, the supporting structure, the main platform, and the lateral supporting means are modular.

In accordance to an embodiment of the present invention, the system further comprises a dismantling structure employable to the main platform and the supporting structure to facilitate dismantling of the main platform. Preferably, the dismantling structure comprising a truss structure configured in a bridge configuration employable to the main platform and attachable to the building supporting structure to bear the main platform.

It is an object of the present invention to provide a system for internal climbing of a tower crane that is flexible and durable. The rotatable outrigger arms allow offsetting of the center of the main platform and the supporting platform to therefore horizontally adjust the positioning of the tower crane. This gives flexibility in positioning the crane within the opening of a building under construction.

It is another object of the present invention to provide a system for repositioning a tower crane within a wide range of heights, by employing the ladder to allow the main platform and to climb along the ladder attached to the supporting platform, which acts as a track. The system also allows the tower crane to be moved downwards if there is a need, along the ladder.

The foregoing and other objects, features, aspects and advantages of the present invention will become better understood from a careful reading of a detailed description provided herein below with appropriate reference to the accompanying drawings.

BRIEF DESCRIPTION OF DRAWINGS

It is noted that the drawings may not be to scale. The drawings are intended to depict only typical aspects of the invention, and therefore should not be considered as limiting the scope of the invention. In the drawings, like numberings represent like elements between the drawings.

DETAILED DESCRIPTION OF EMBODIMENTS

It should be noted that the following detailed description is directed to a system (100) for repositioning at least one crane (101) superposed on a tower (102), which is not limited to any particular size or shape, but in fact may be presented in a multitude of sizes and shapes within the general scope of the following description.

Figure 1:
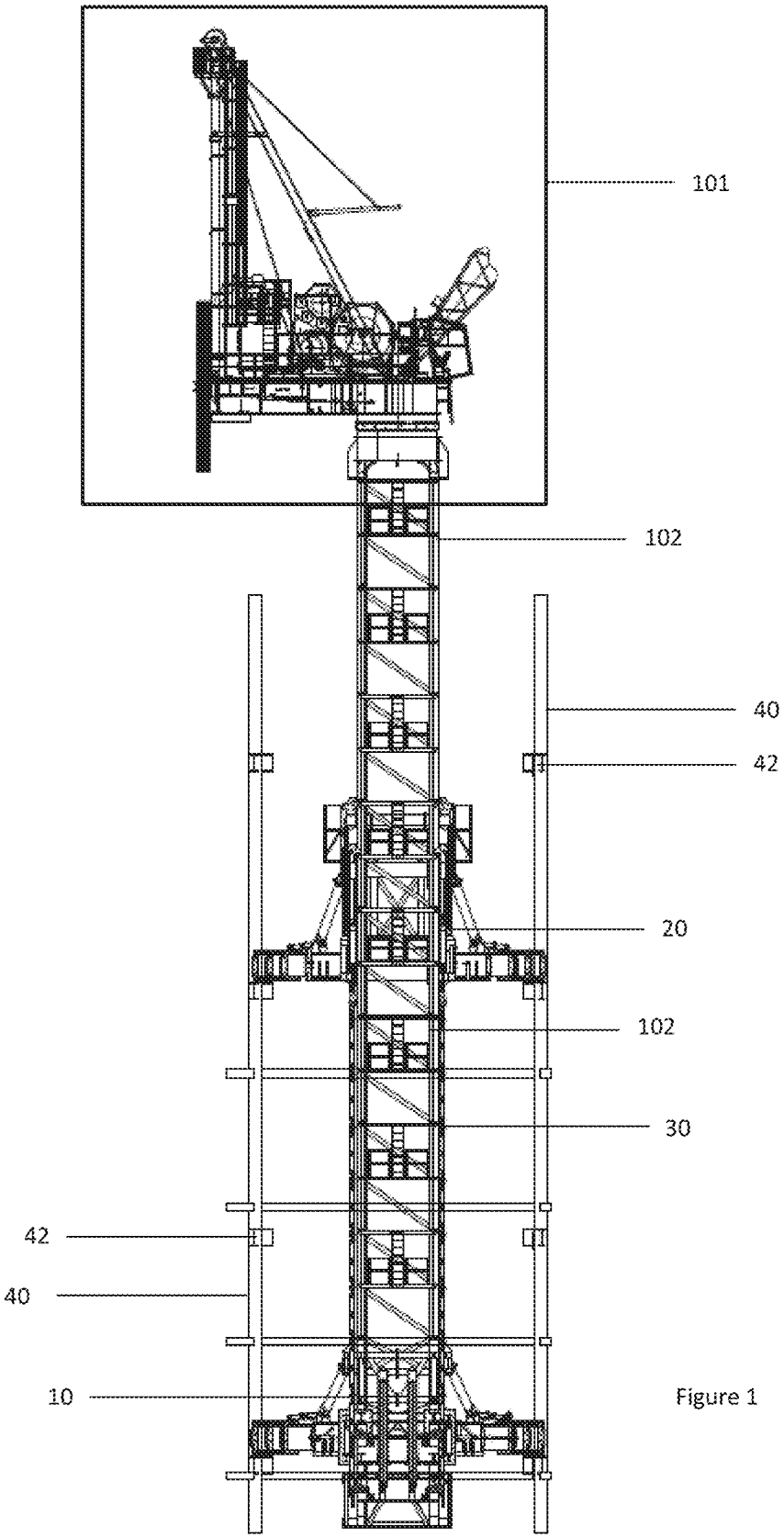
FIG. 1 shows an overview of the system, in accordance to an embodiment of the present invention.
Figure 2:
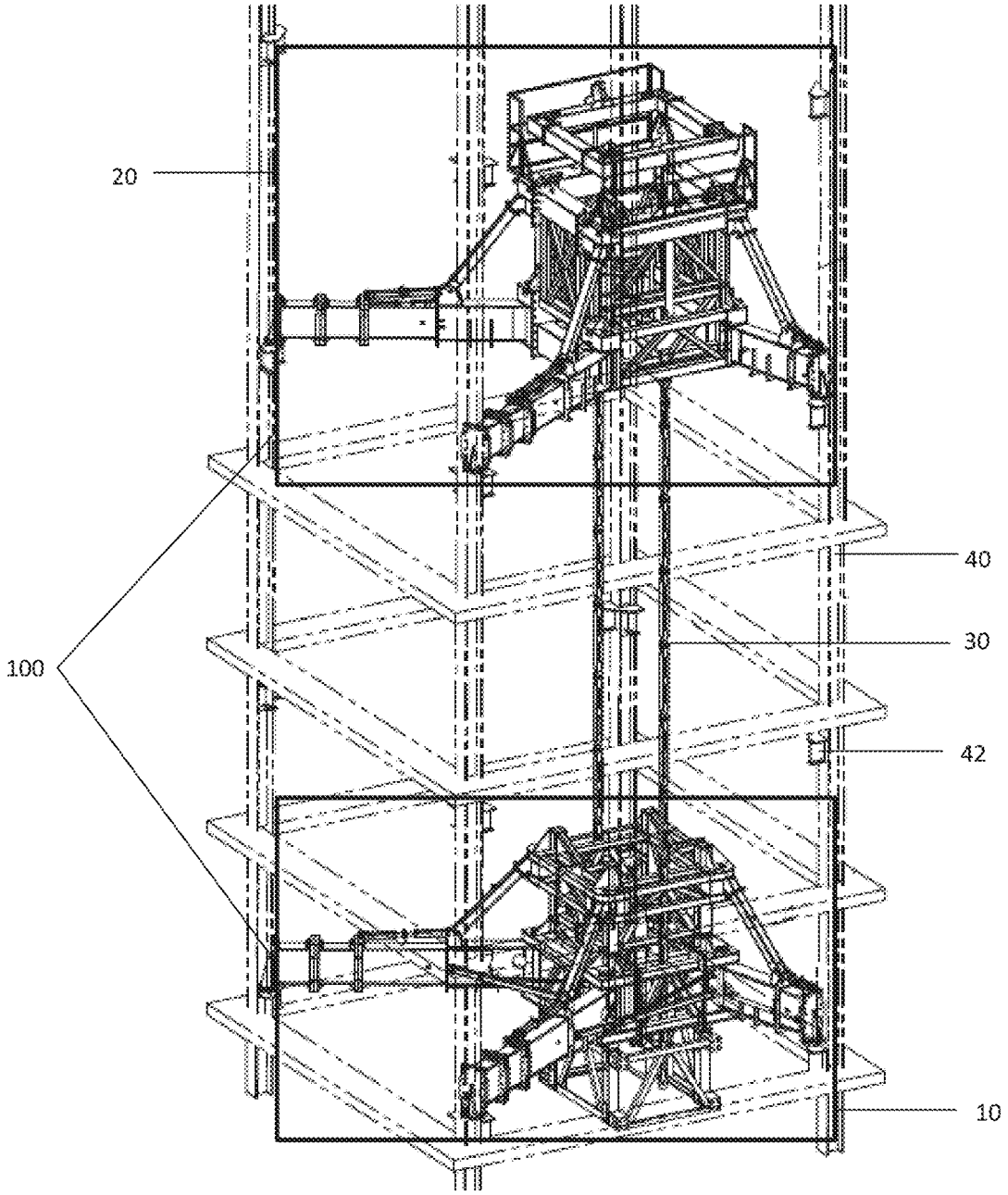
FIG. 2 shows a perspective view of the system, in accordance to an embodiment of the present invention.

With reference to FIGS. 1 and 2, the present invention relates to a system (100) for repositioning at least one crane (101) superposed on a tower (102) that is positioned within a bay of a building structure and surrounded by a supporting structure (40) within the bay of the building, whereby the supporting structure (40) comprises a plurality of repositionable support brackets (42). The system comprises at least one supporting platform (20) reversibly mounted to the tower (102) by a plurality of support hooks (27), a ladder (30) vertically suspended from the supporting platform (20) adapted as a track, and a main platform (10) adapted to carry and reposition the tower (102) comprising at least one first lifting means (13) configured to reversibly extend the main platform (10), at least a first climbing means (12) and a second climbing means (14) reversibly engageable to the ladder (30).

The system (100) is preferably employable to a building structure having a plethora of possible supporting structure (40) configurations. A building under construction typically possesses a supporting structure to support the building's construction process. The supporting structure (40) is typically positioned within the bay of the building in a configuration that a building requires. In order to describe the embodiment of the present invention, the system (100) is employed to the supporting structure (40) that comprises four columns arranged in a square, rectangular, or any other formation with the tower (102) positioned therein. It is preferred for the support brackets (42) to be repositionable vertically along the columns of the supporting structure (40) to facilitate flexible repositioning of the tower (102). Preferably, each of the columns comprises the repositionable support brackets (42).

The main platform (10) or both the main platform (10) and the supporting platform (20) are preferably equipped with a lateral supporting means (24, 15) to support loads imposed by the tower (102) and the crane (101) by transferring the load to the supporting structure (40) during operations of the crane (101). The lateral supporting means (24, 15) comprises a plurality of outrigger arms (24, 15) extending from the main platform (10) or the main platform (10) and the supporting platform (20) adapted to reversibly connect to the supporting structure (40) for connecting the main platform (10) and the supporting platform (20) to the supporting structure (40) by the support brackets (42). It is preferred for both the main platform (10) and the supporting platform (20) to be equipped with the lateral supporting means (24, 15). The supporting platform (20) is adapted to transfer operational loads to the supporting structure (40) during tower (101) crane (102) repositioning process. The supporting platform (20) may also be adapted to transfer operational loads of the tower crane (102) to the supporting structure (40) along with the main platform (10), thereby providing greater stability to the tower (102) and the crane (102).

Figure 3A:
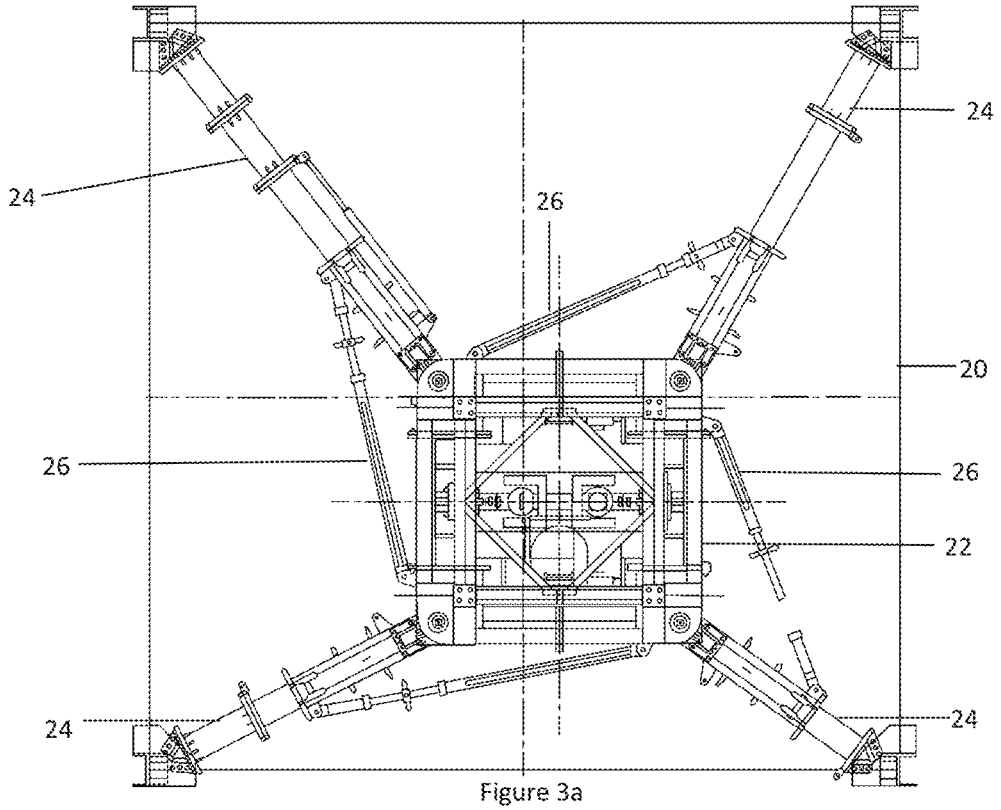
FIG. 3*a* shows a top view of the main platform in an opening of a building, in accordance to an embodiment of the present invention.
Figure 3B:
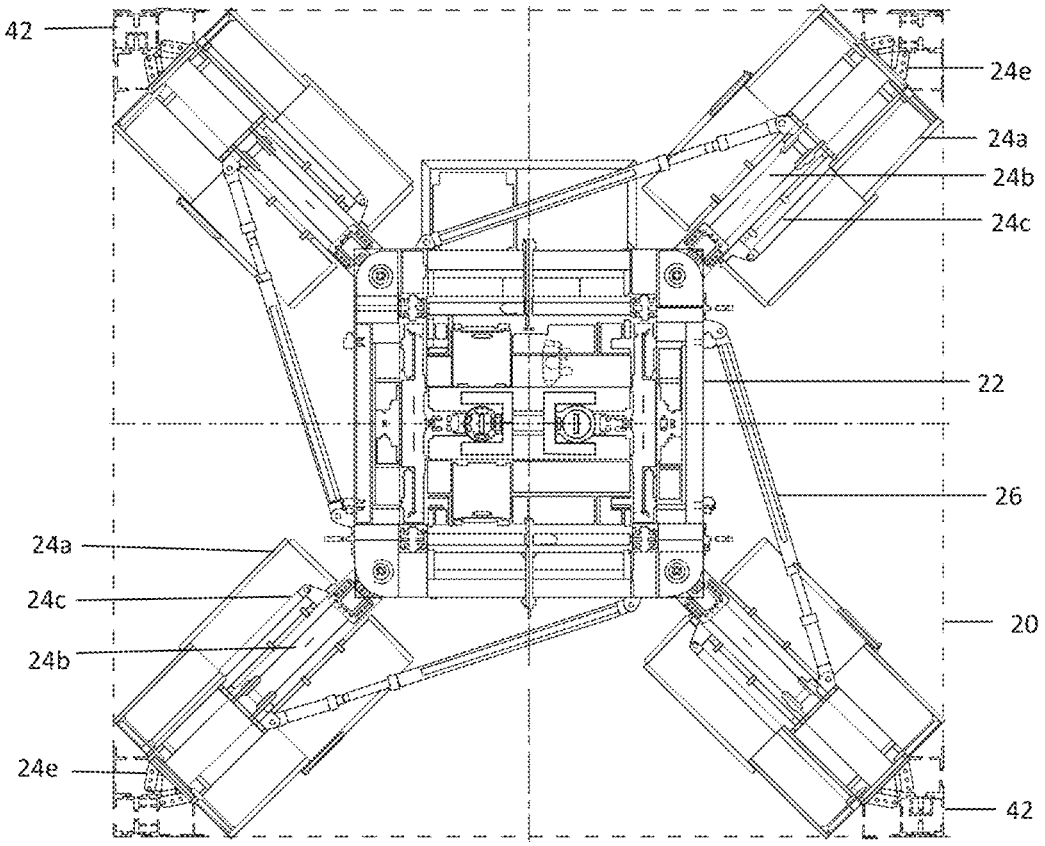
FIG. 3*b* shows another top view of the main platform in another opening of a building, in accordance to an embodiment of the present invention.

Preferably the outrigger arms (24, 15) are retractable and rotatable by the main platform (10) and the supporting platform (20). The outrigger arms (24, 15) are retractable in order to allow the outrigger arms (24, 15) to retract from the supporting brackets (42) to initiate repositioning of the tower crane and to allow the outrigger arms (24,15) to extend to the next supporting brackets (42), after the repositioning is performed. Further, the provision of the rotatable outrigger arms (24, 15), as shown in FIGS. 3*a* and 3*b*, allows the main platform (10) and the supporting platform (20) to connect to the structural support (40) to transfer operational loads from tower crane repositioning operation, while allowing the main platform (10) and the supporting platform (20) to horizontally move within the supporting structure (40), thereby moving the tower (102) by offsetting the position of the main platform (10) and the supporting platform (20) from its centerline. This provides flexibility in a construction operation, including allowing the tower (102) to be moved horizontally to provide more space for performing construction work within the building openings that would otherwise be blocked by the tower (102) if not horizontally offset from its centerline. Further, the retractable outrigger arms (24, 15) provides great flexibility as the outrigger arms (24, 15) may reach to various configurations of support structure (40) and its brackets (42), thereby allowing the system (100) to be employed to buildings of various sizes and configurations with various bay sizes. The configuration of the outrigger arms (24, 15) also allows flexibility for workers involved in building construction to utilize the outrigger arms (24, 15) for multitude of other works by adjusting the position of the brackets (42) and then extending the outrigger arms (42) towards the brackets (42), thereby creating access for the workers to the level the brackets (42) are positioned at. Further, the configuration of the outrigger arms (24, 15) being flexible allows the brackets (42) to be repositioned at a greater range of position.

Figure 6:
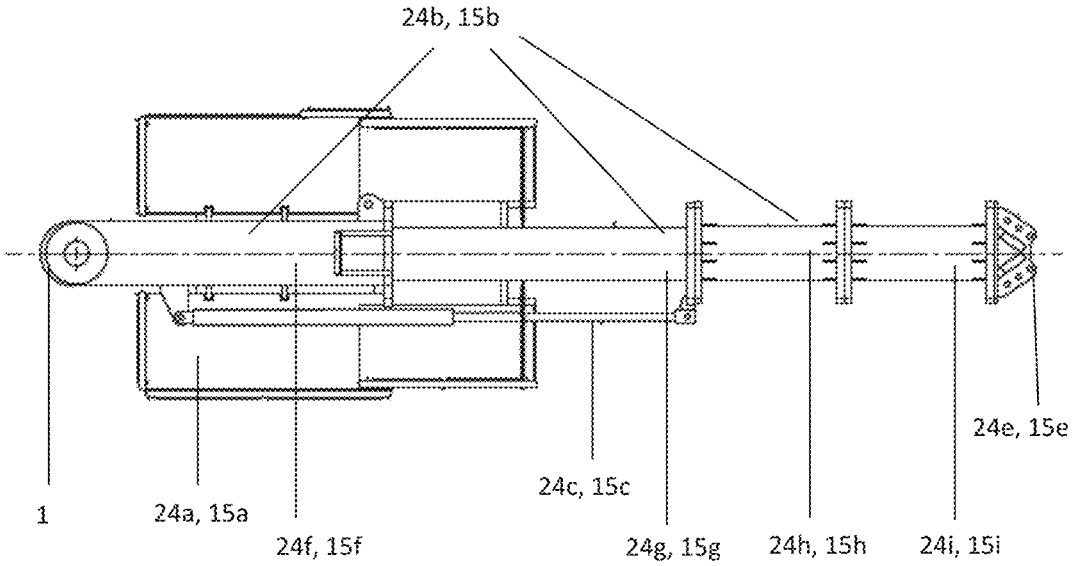
FIG. 6 shows a top view of the lateral supporting means, in accordance to an embodiment of the present invention.

With reference to FIG. 6, the outrigger arms (24, 15) are preferably connected to the main platform (10) and the supporting platform (20) by a pin (1), which allows the outrigger arms (24, 15) to rotate about the pin (1) axis. Preferably, the outrigger arms (24, 15) are configured to rotate along the Z-axis of the main platform (10) and the supporting platform (20). Preferably, the outrigger arms (24, 15) comprises an outrigger beam (24*b*, 15*b*) extendable from an outrigger housing (24*a*, 15*a*) connected to the main platform (10) or, more preferably, the main platform (10) and the supporting platform (20) by the pin (1). The outrigger beams (24*b*, 15*b*) are allowed to extend by the provision of telescopic arrangement of the outrigger beams (24*b*, 15*b*), whereby the outrigger beams (24*b*, 15*b*) comprise a plurality of beams (24*f*, 24*g*, 24*h*, 24*i*, 15*f*, 15*g*, 15*h*, 15*i*) connected telescopically to each other configured to telescopically extend from the outrigger housing (24*a*, 15*a*). The plurality of beams are preferred to be connected to each other by at least one hydraulic cylinder (24*c*, 15*c*). The hydraulic cylinder (24*c*, 15*c*) is configured to provide sufficient force to extend and retract the (24*c*, 15*c*) outrigger beams (24*b*, 15*b*), in order to facilitate operation of the tower repositioning, specifically to engage and disengage the outrigger beams (24*b*, 15*b*) from the support brackets (42) during tower repositioning. The extension and retraction of the outrigger beams (24*b*, 15*b*) allows the outrigger arms (24, 15) to flexibly access different points of the supporting structure (40).

Figure 7:
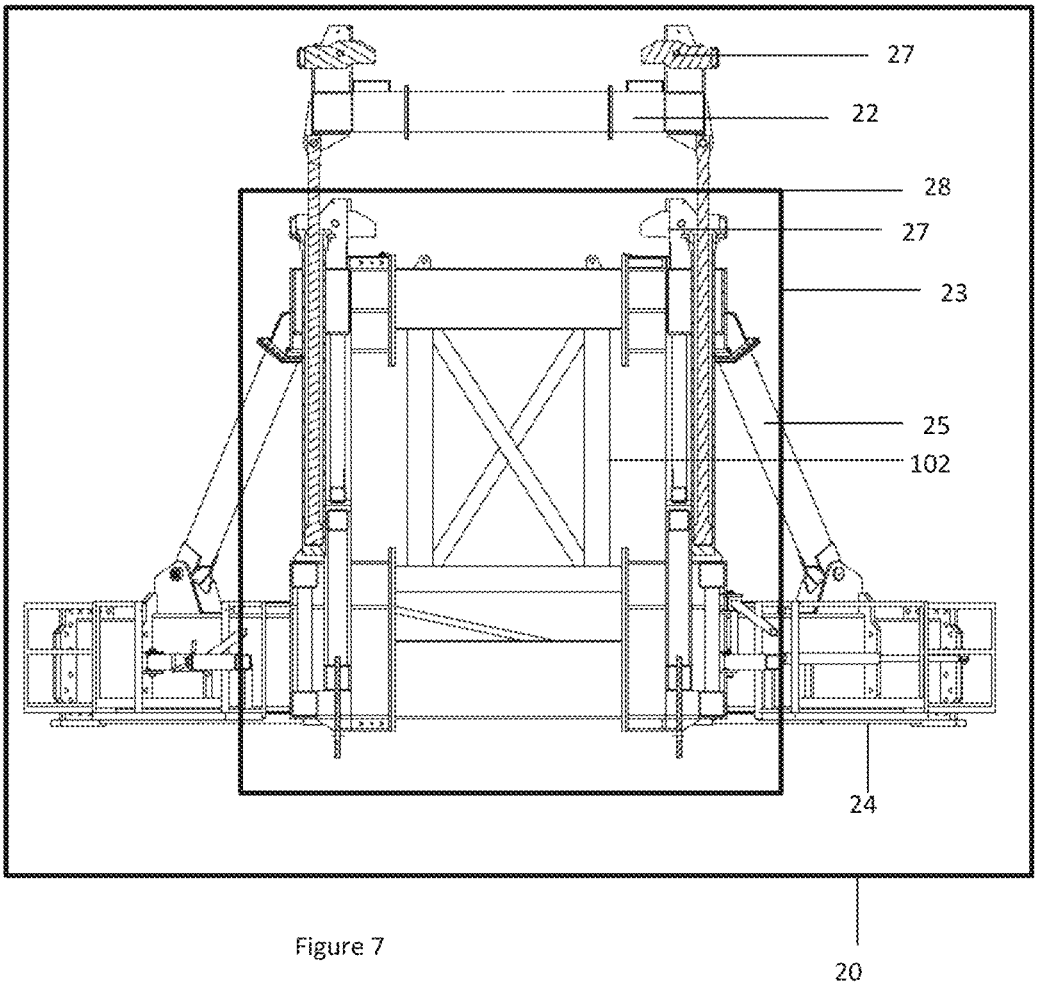
FIG. 7 shows a section view of the supporting platform, in accordance to an embodiment of the present invention.
Figure 10:
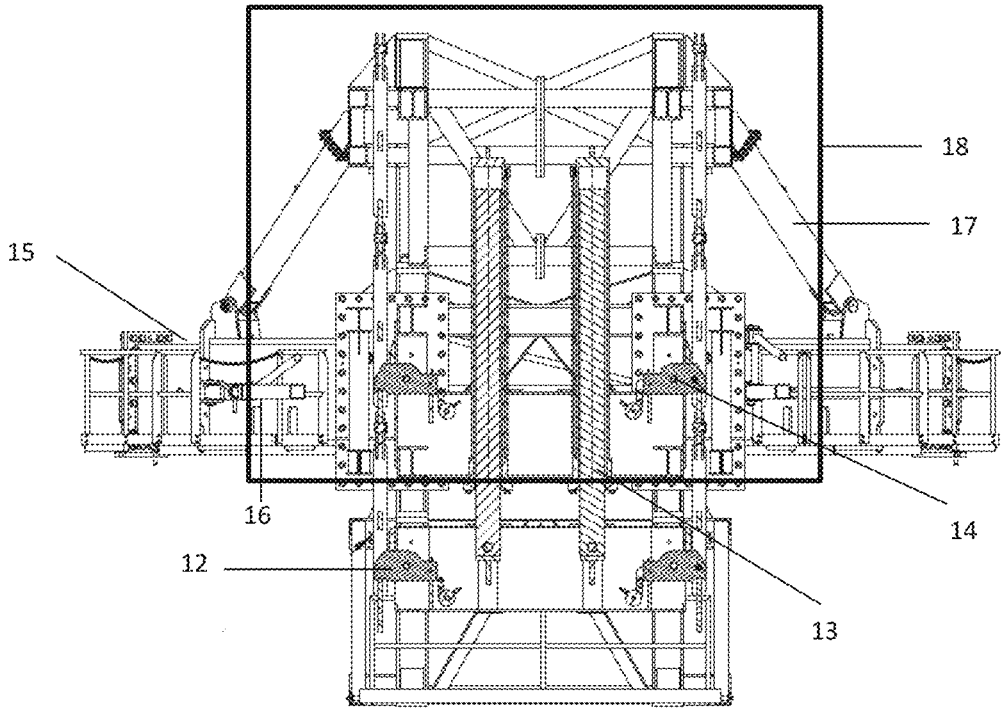
FIG. 10 shows a section view of the main platform, in accordance to an embodiment of the present invention.
Figure 11:
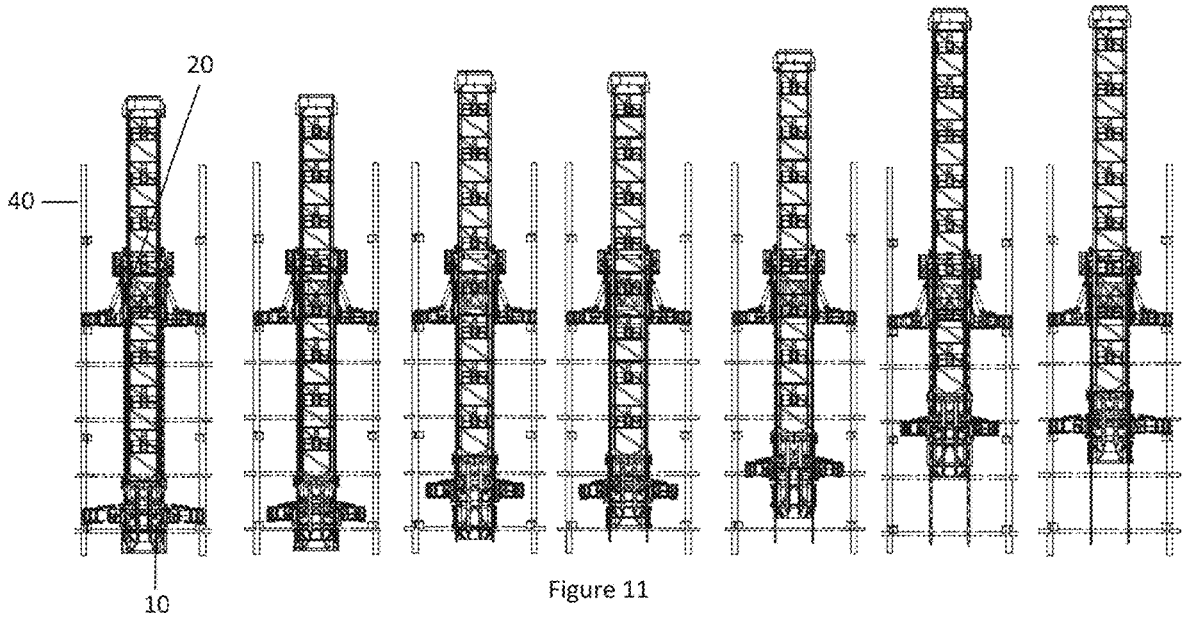
FIG. 11 shows an overview of the repositioning of the tower crane applied in accordance to an embodiment of the present invention.
Figure 12:
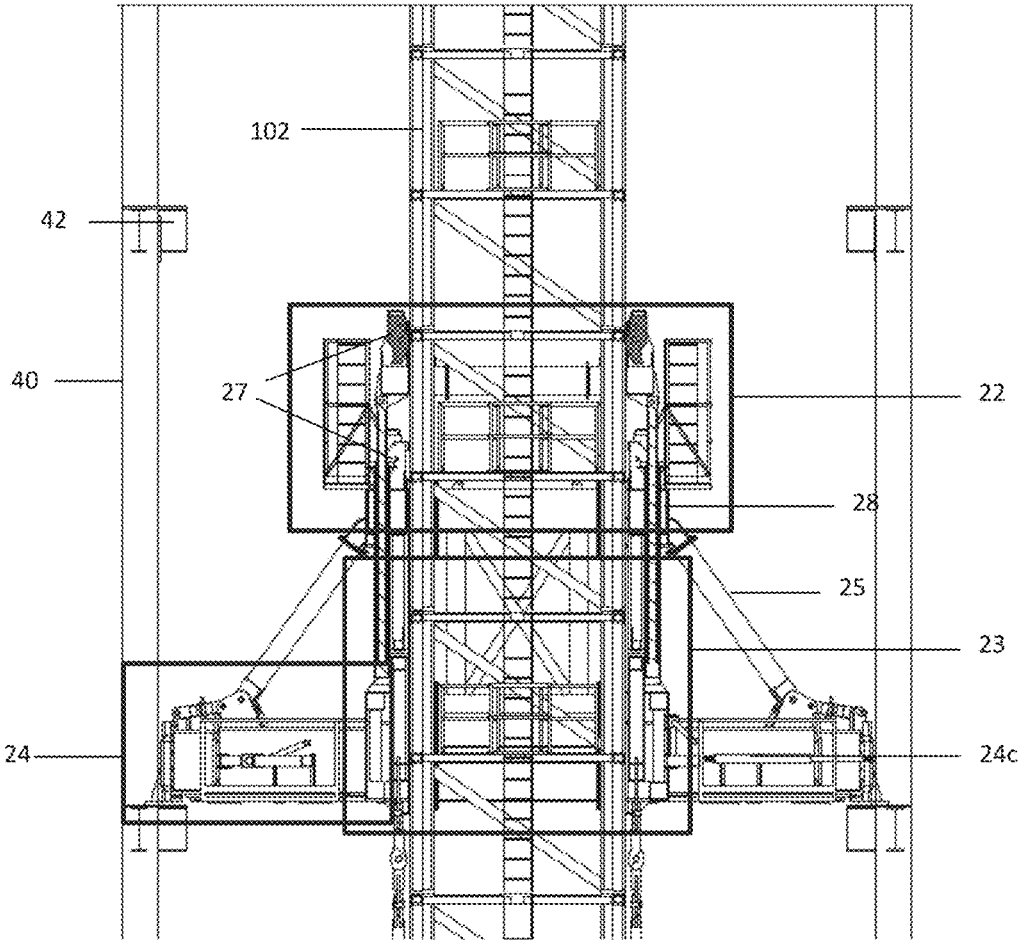
FIG. 12 shows a section view of the supporting platform during tower crane repositioning, in accordance to an embodiment of the present invention.
Figure 13A:
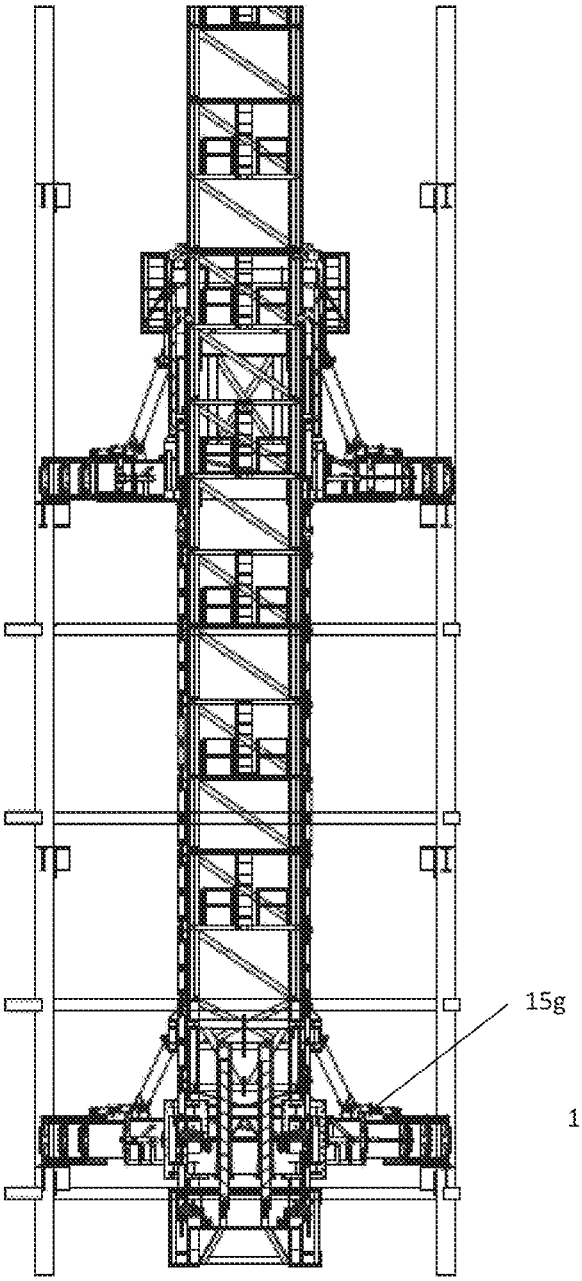
FIG. 13*a* shows the tower crane repositioning process of the system, in accordance to an embodiment of the present invention.
Figure 13B:
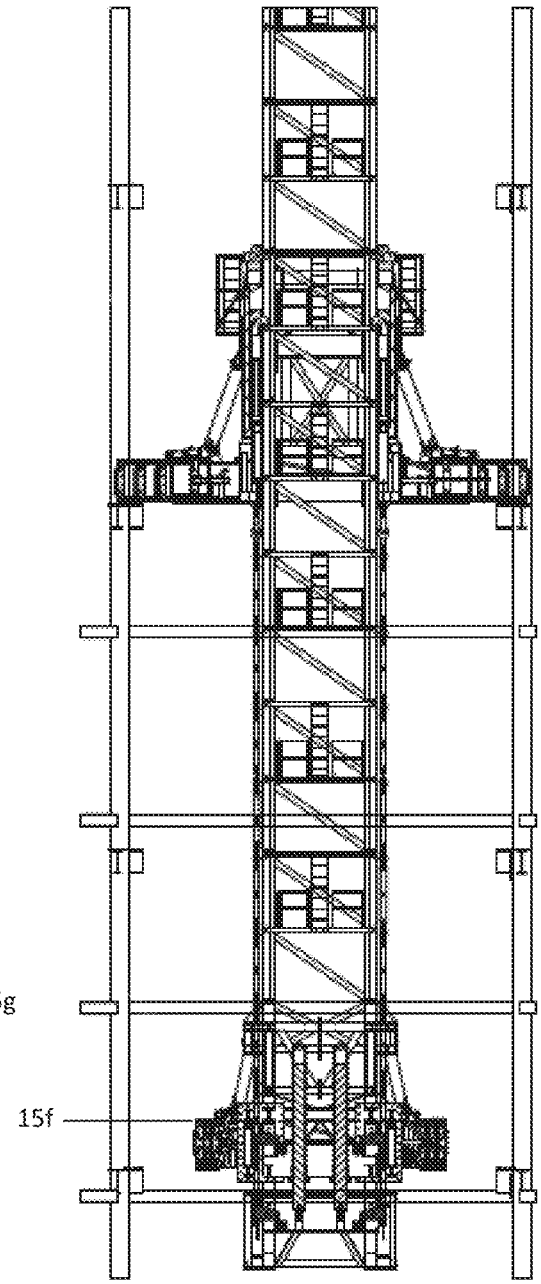
FIG. 13*b* shows the tower crane repositioning process of the system, in accordance to an embodiment of the present invention.

In order to strengthen the outrigger arms (24, 15), a horizontal brace (26, 16) and a vertical brace (25, 17) are configured to the main platform (10) and the supporting platform (20), as shown in FIG. 7 and FIG. 10. The horizontal brace (26, 16) and the vertical brace (25, 17) are configured to extend from the outrigger housing (24*a*, 15*a*) towards the main platform (10) and the supporting platform (20). The outrigger arms (24, 15) are connected to the supporting structure from the main platform (10) and the supporting platform (20) by a connecting point (24*e*, 15*e*), which is configured to allow connection to the repositionable support brackets (42). The connection can be secured by using various reversible fastening means, such as bolting the connecting point (24*e*, 15*e*) to the repositionable support brackets (42).

Figure 4:
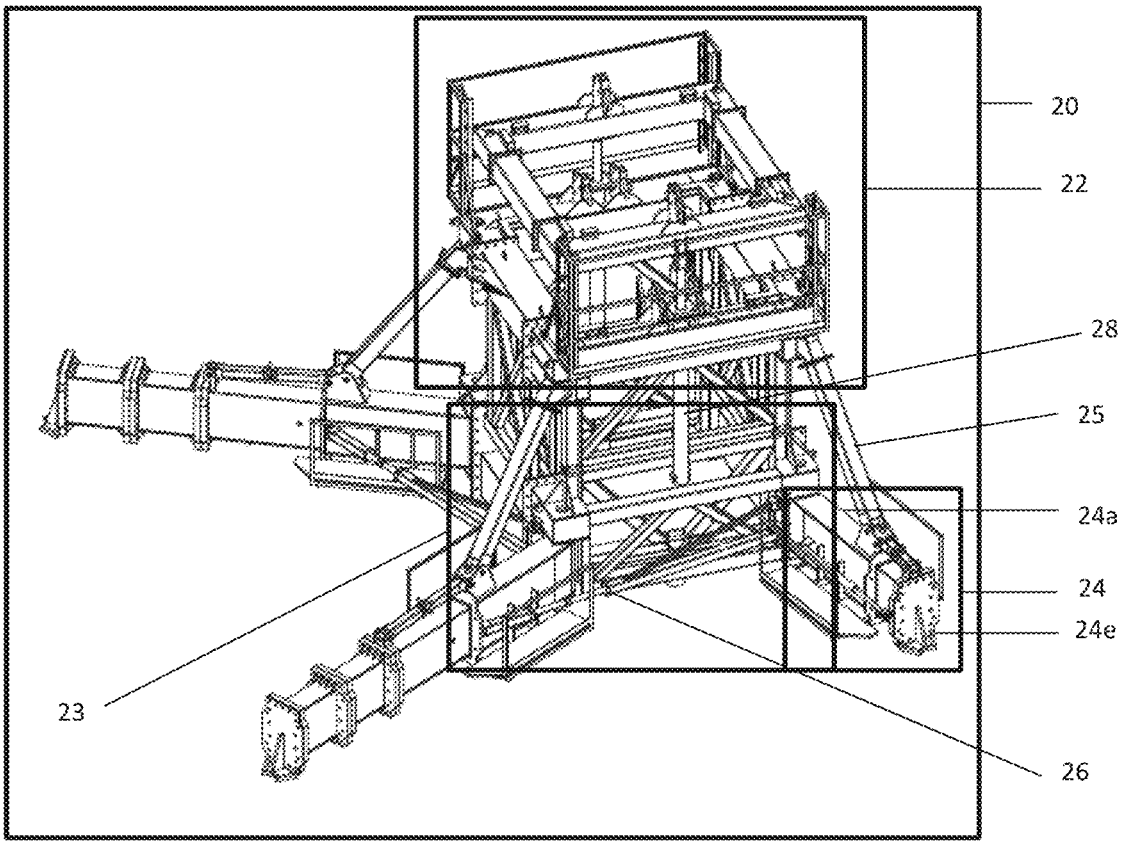
FIG. 4 shows a perspective view of the supporting platform, in accordance to an embodiment of the present invention.
Figure 5:
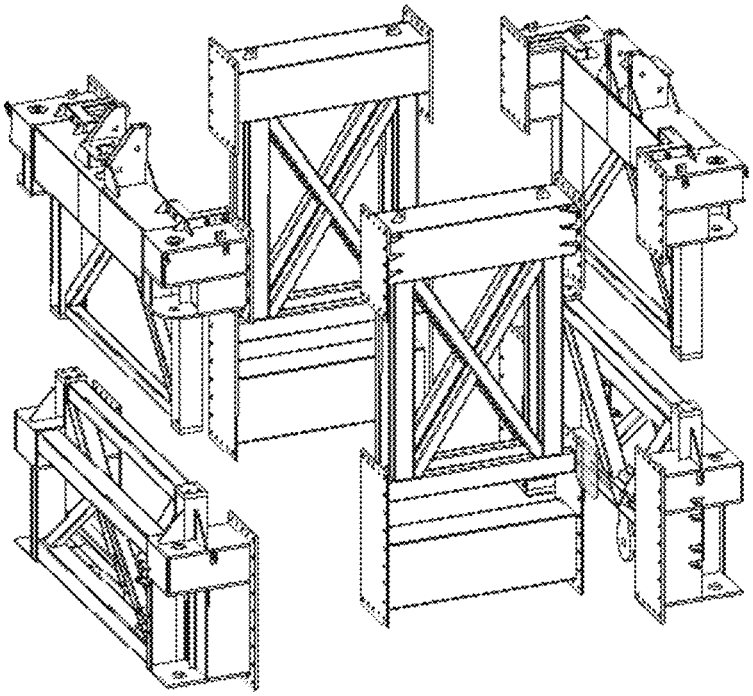
FIG. 5 shows an exploded view of the modular supporting platform, in accordance to an embodiment of the present invention.
Figure 14:
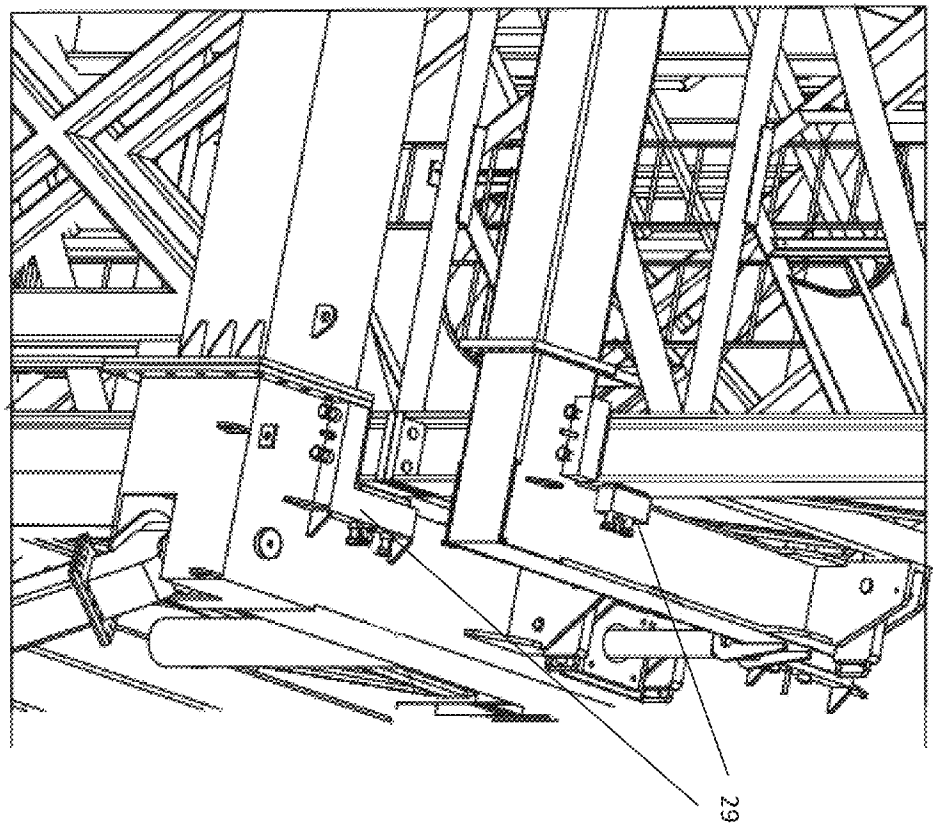
FIG. 14 shows a perspective view of the guides on supporting platform, in accordance to an embodiment of the present invention.
Figure 15A:
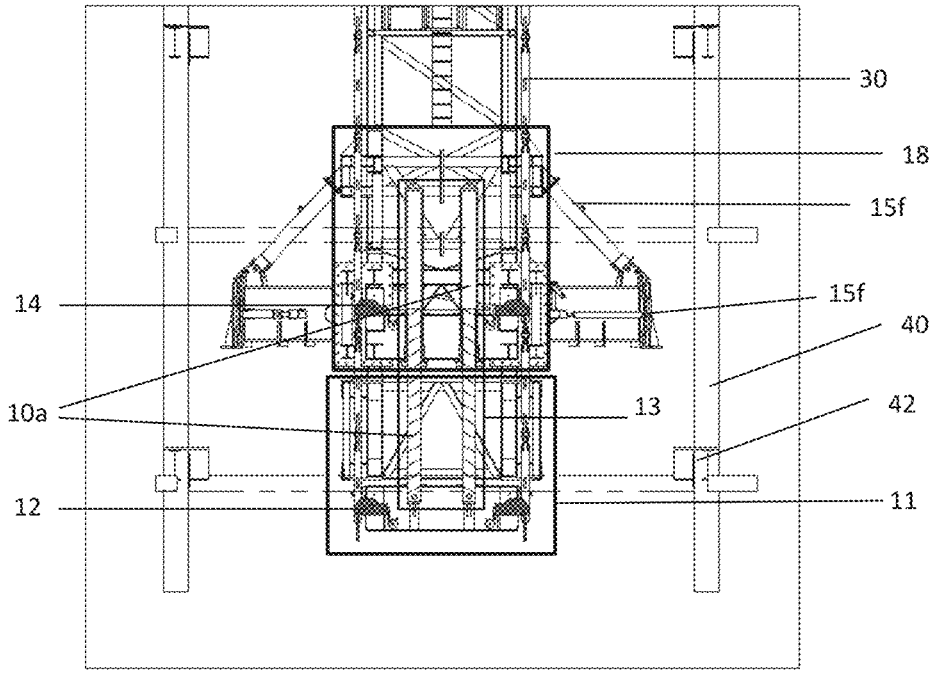
FIG. 15*a* shows a section view of the main platform during tower crane repositioning, in accordance to an embodiment of the present invention.
Figure 15B:
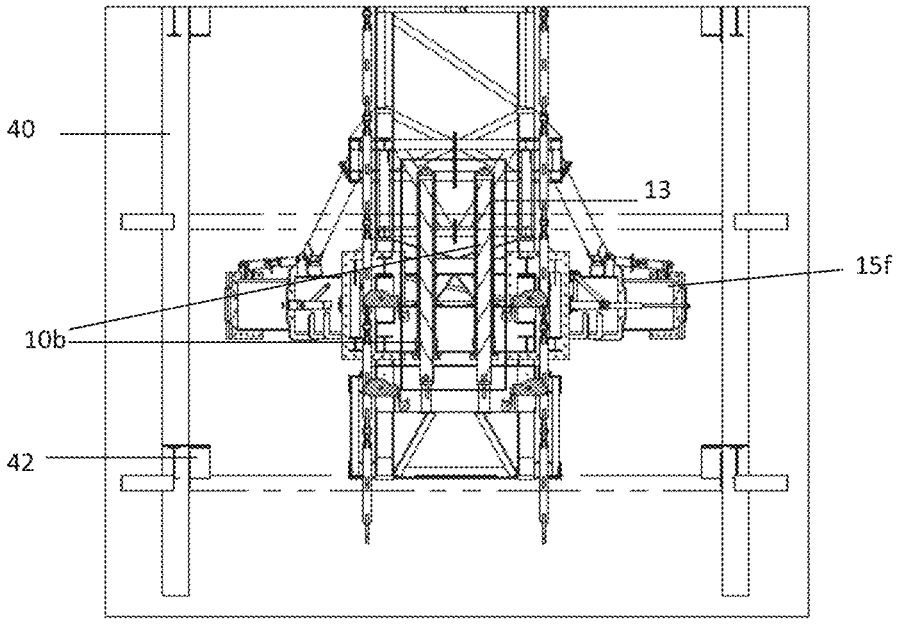
FIG. 15*b* shows a section view of the main platform during tower crane repositioning, in accordance to an embodiment of the present invention.
Figure 15C:
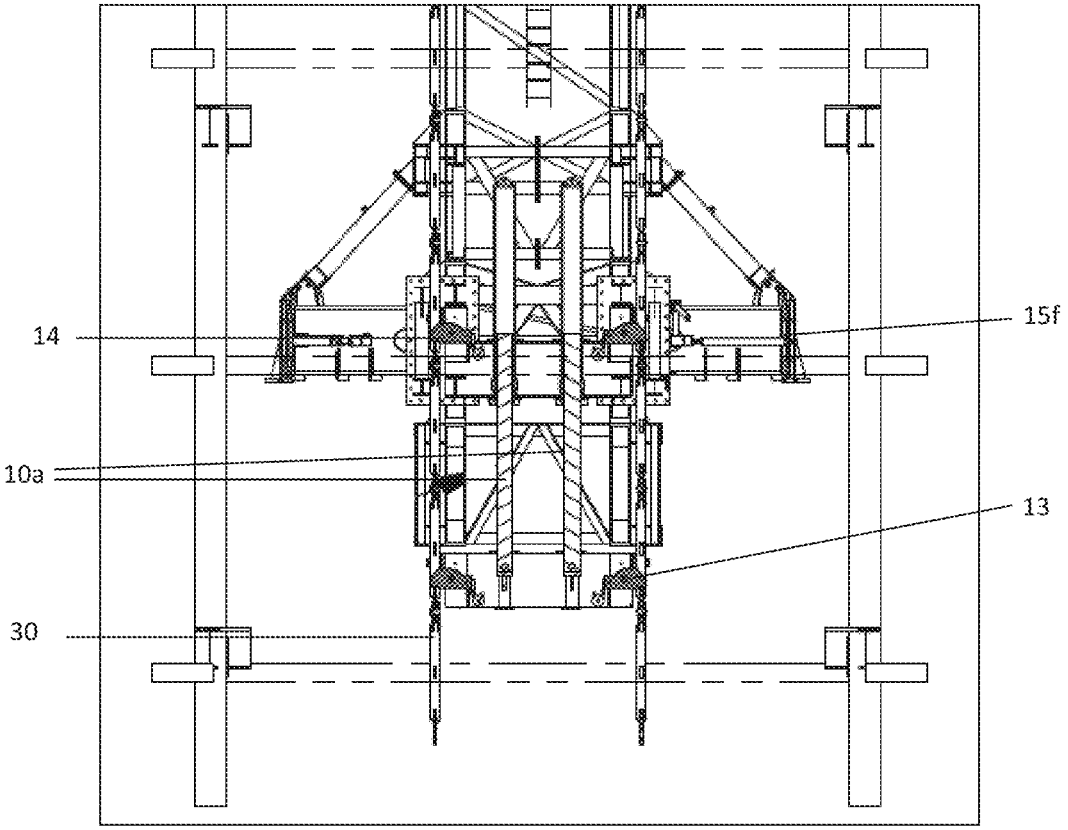
FIG. 15*c* shows a section view of the main platform during tower crane repositioning, in accordance to an embodiment of the present invention.
Figure 15D:
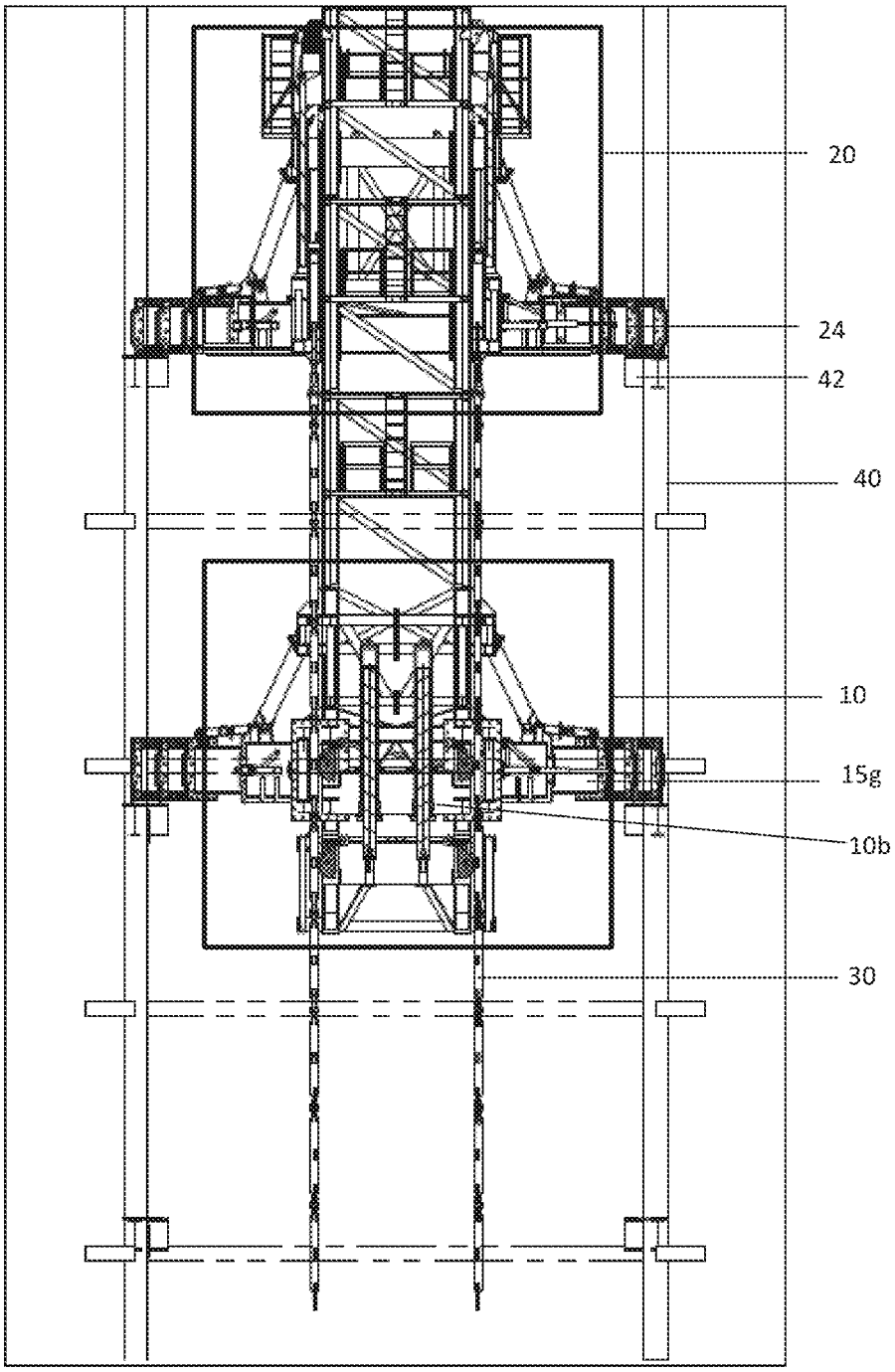
FIG. 15*d* shows a section view of the main platform during tower crane repositioning, in accordance to an embodiment of the present invention.

The supporting platform (20) preferably comprises a first section (22) and a second section (23), as shown in FIGS. 4 and 7. The first section (22) and the second section (23) are equipped with a plurality of support hooks (27), which allows mounting of the supporting platform (20) to the tower (102). The plurality of support hooks (27) can be rotated about a pivot point to briefly disconnect the supporting platform from the tower (102). Preferably, as shown in FIG. 14, the first section (22) and the second section (23) comprise a plurality of guides (29) to maintain the Z-axis stability of the tower (102) during tower repositioning. The guides (29) are preferably made of at least one adjustable clamp block adapted to the supporting platform (20), wherein the adjustable clamp block can be adjusted to increase proximity of the clamp block to the tower (102) during tower repositioning. This allows the tower (102) to maintain verticality during tower (102) repositioning. Specifically, the guides (29) provide an additional safety feature to the tower (102) during the climbing process, whereby the tower's (102) non-vertical movement during the climbing process is limited by the guides (29).

Figure 8:
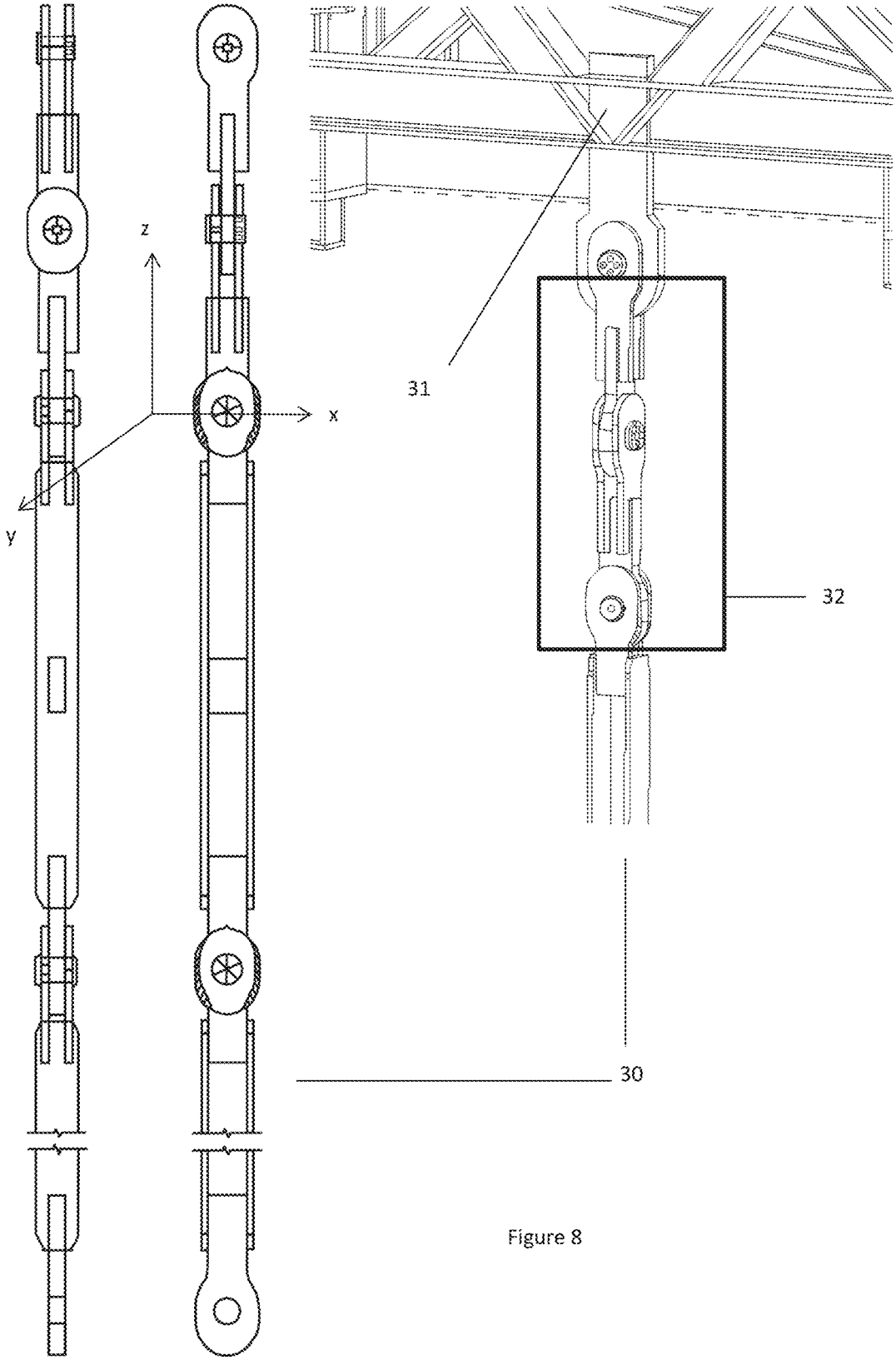
FIG. 8 shows views of the ladder, in accordance to an embodiment of the present invention.

With reference to FIG. 8, the ladder (30) is configured with a plurality of rungs, which act as a receiver for the first climbing means (12) and the second climbing means (14) of the main platform (10). The ladder (30) is preferred to be rotatable about the X and Y axis with respect to the supporting platform (20) at the connection (31, 32) to the supporting platform (20). The ladder (30) is configured to be rotatable to ensure that the connection of the ladder (30) to the supporting structure (20) is not subject to excessive loading in case of any misalignment between the supporting platform (20) and the main platform (10) when the main platform (10) is attached to the ladder (30). This limits excess loading in the ladder's (30) connection on the supporting platform (20) due to misalignments that might occur during tower repositioning process. The ladder (30) are connected to the supporting structure (20) by at least one lug (31) and at least one connector (32), that is adapted to allow the said rotation. The ladder (30) is adapted to enable load transfer between the ladder (30) and the supporting platform (20) to be uniformed by virtue of the ladder (30) being rotatable about the X and Y axis. The ladder (30) is adapted to carry the load of the tower (102) and the crane (101) by carrying the main platform (10) during tower repositioning process.

Figure 9:
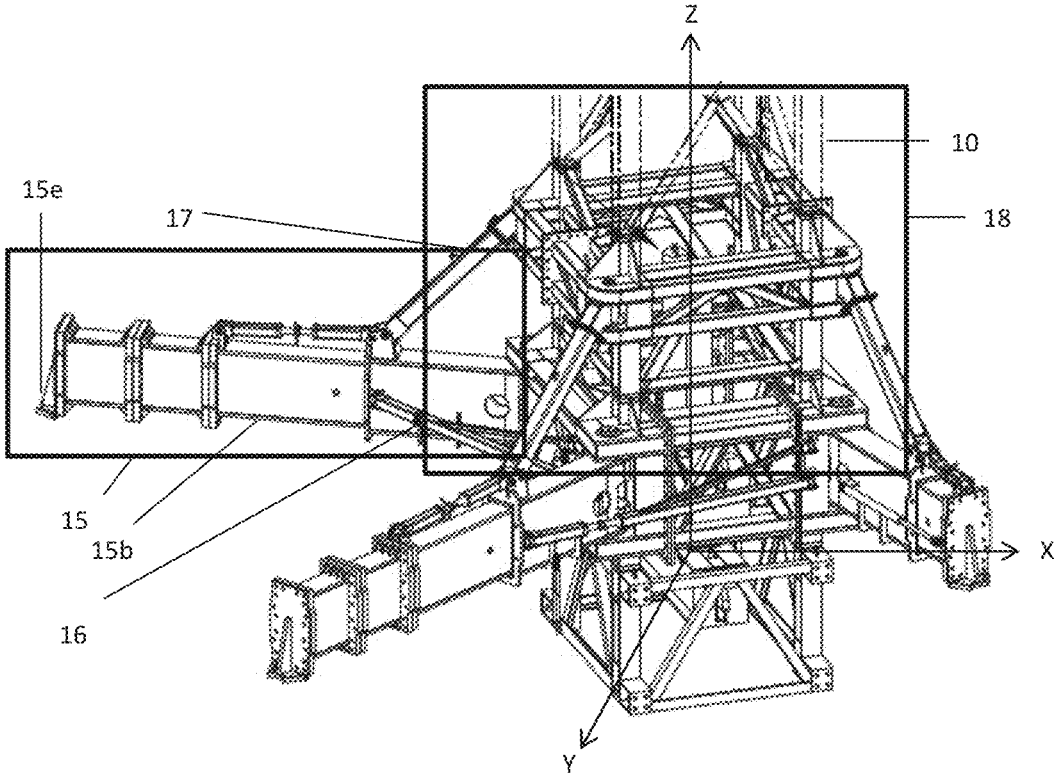
FIG. 9 shows a perspective view of the main platform, in accordance to an embodiment of the present invention.

The main platform (10) further comprises a first assembly (11) for supporting the weight of the tower (102) and the crane (101) during repositioning of the tower; and is vertically connected to a second assembly (18) by the first lifting means (13). With reference to FIG. 9, the second assembly (18), on the other hand, is attached to the tower (102) and is adapted to be able to carry the weight of the tower (102) and the crane (101). Preferably, the second assembly (18) is assembled and secured to the tower with heavy duty bolts or other suitable means.

The first climbing means (12) preferably comprises a plurality of hooks that is adapted to latch to the rungs of the ladder (30), whereby the plurality of hooks are preferably pivotally connected to the first assembly (11). The second climbing means (14) is also equipped with a plurality of hooks adapted to latch to the rungs of the ladder (30), pivotally connected to the second assembly (18). The arrangement of the pivotal connection of the first climbing means (12) allows the plurality of hooks to rotate to latch to the rungs of the ladder (30) as the first assembly (11) is lifted up by the first lifting means (13).

With reference to FIGS. 11, 12, 13*a*, 13*b*, 15*a*, 15*b*, 15*c*, and 15*d*, generally, the system (100) is configured to reposition the tower (102) and the crane (101) by utilizing the main platform (10). The main platform (10) is configured to reposition the tower (102) and the crane (101) by engaging the first climbing means (12) of the first assembly (11) to the climbing ladder (30) to support the tower (102), retracting the outrigger arms (15) towards the second assembly (18) to clear the movement path of the main platform (10) from being obstructed by the support brackets (42), extending the main platform (10) by extending (10*a*) the first lifting means (13) to move the second assembly (18) upwards to a desired level of repositioning, thereby moving the tower (102) and the crane (101) along with the movement of the second assembly (18), engaging the second climbing means (14) to the ladder (30) at the desired level, disengaging the first climbing means (12) of the first assembly (11) from the climbing ladder (30), and retracting the main platform (10) by activating the first lifting means (13) to retract (10*b*) the first assembly (11) towards the second assembly (18), consequently repositioning the tower (102) along the climbing ladder (30) to reposition at least one crane (101).

In use, in order to reposition the tower (102) and the crane (101), the outrigger arms (24) of the supporting platform (20) are first configured to be extended and connected to the supporting structure (40) by the connecting point (24*e*). The outrigger arms (24) are preferably secured to the repositionable support brackets (42) of the supporting structure (40) by bolts or other possible fastening means.

Next, the plurality of support hooks (27) from both the first section (22) and the second section (23) are then disconnected from the tower (102), thereby transferring the weight of the supporting platform (20) to the supporting structure (40) through the outrigger arms (24), while maintaining verticality of the tower (102) during tower repositioning process. The support hooks (27) are disconnected from the tower (102) to clear the path of the tower (102) to move vertically along the ladder (30).

After the outrigger arms (24) of the supporting platform (20) are secured to the supporting structure (40), the first climbing means (12) is then latched to the ladder (30). Next, the outrigger arms (15) extending from the main platform (10) will be retracted (15*f*) from the support brackets (42) to allow the movement of the main platform (10) by clearing the movement path for the main platform (10) from the support brackets (42). Next, the first lifting means (13) is activated to extend and retract (10*a* and 10*b*) the main platform (10) by moving the first assembly (11) and the second assembly (18) away and towards each other, respectively. In order to commence the extension (10*a*) of the main platform (10), the first lifting means (13), upon activation, is configured to reposition the second assembly (18) upwards to a preferred height along with the tower (102) and crane (101). The second assembly (18) is preferably repositioned to a point that allows the second climbing means (14) to align and latch to the rungs of the ladder (30).

After the second climbing means (14) are latched to the ladder (30), the first climbing means (12) of the first assembly (11) is adapted to unlatch from the rungs of the ladder (30). The first lifting means (13), which could be a hydraulic cylinder or any other possible means to extend the main platform (10) to elevate the tower (102) and crane (101), is activated thereafter to retract (10*b*) the first assembly (11) of the main platform (10) towards the second assembly (18), thereby completing the repositioning (elevating) of the tower (102) along the ladder (30).

The above steps are then repeated to the point that the tower (102) reaches a desired height. Upon reaching the desired height, the outrigger arms (15) are then extended towards the supporting structure (40) to connect the main platform (10) to the supporting structure (40) by the support brackets (42). The second climbing means (14) are then unlatched from the ladder (30) and the supporting platform (20) are connected to the tower (102) by deploying the supporting hooks (27) to the tower (102).

In one embodiment, the main platform (10) and the supporting platform (20) comprise substantially similar dimensions and strength in order to allow the main platform (10) and the supporting platform (20) to cooperatively support the working load of the tower (102) crane (101) during operation of the crane (101). In this configuration, it is preferable for the outrigger arms (24) of the supporting platform (20) and the outrigger arms (15) of the main platform (10) to have substantially similar dimensions, with substantially similar strength profiles.

In another embodiment, the main platform (10) can be configured to be dimensionally bigger and built sturdier than the supporting platform (20). The outrigger arms (15) of the main platform (10) are also preferred to be sturdier and bigger than the outrigger arms (24) of the supporting structure (20), to improve transfer of operational loads (loads induced by crane during operation of the crane (102) at a building under construction) from the tower (102) and crane (101) to the structural support (40). This configuration is preferred when the upper part of a building structure is unable to carry higher loads associated with the operations of the tower (102) crane (101).

Preferably, at least 3 outrigger arms (24, 15) are used as a lateral supporting means in the system (100). However, it is possible to have more than 3, depending on needs of a building.

In accordance to another embodiment of the invention, the supporting platform (20) is extendable and retractable in a similar manner of the main platform (10), yet differing to the main platform (10) in that the supporting platform (20) is not configured to carry the tower (102) crane (101). The supporting platform (20) is configured to reversibly mount to the tower (102) by a plurality of support hooks (27) that are rotatable by a pivot. The supporting platform (20) is configured to be extendable in order to allow repositioning of the supporting platform (20) along the tower (102). The supporting platform (20), which comprises the first section (22) and the second section (23), is preferably equipped with at least one second lifting means (28), which connects the first section (22) and the second section (23).

Figure 16A:
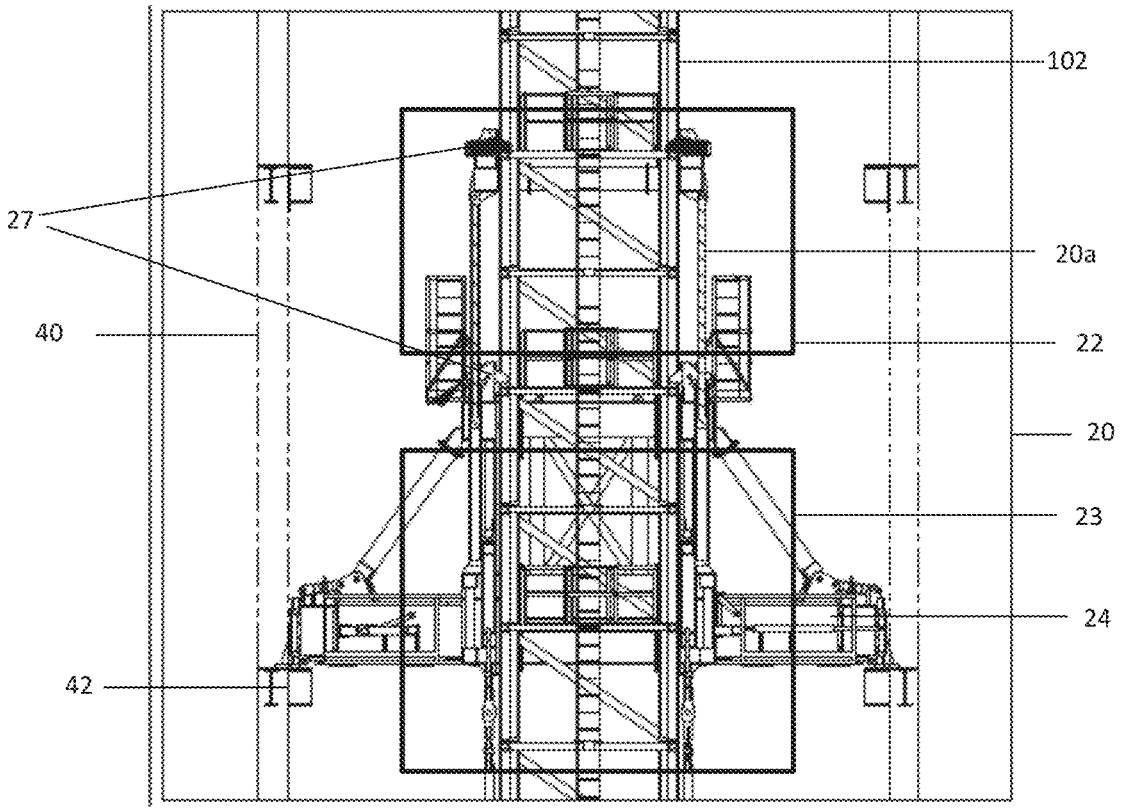
FIG. 16*a* shows a section view of the supporting platform repositioning to enable a further tower crane repositioning, in accordance to an embodiment of the present invention.
Figure 16B:
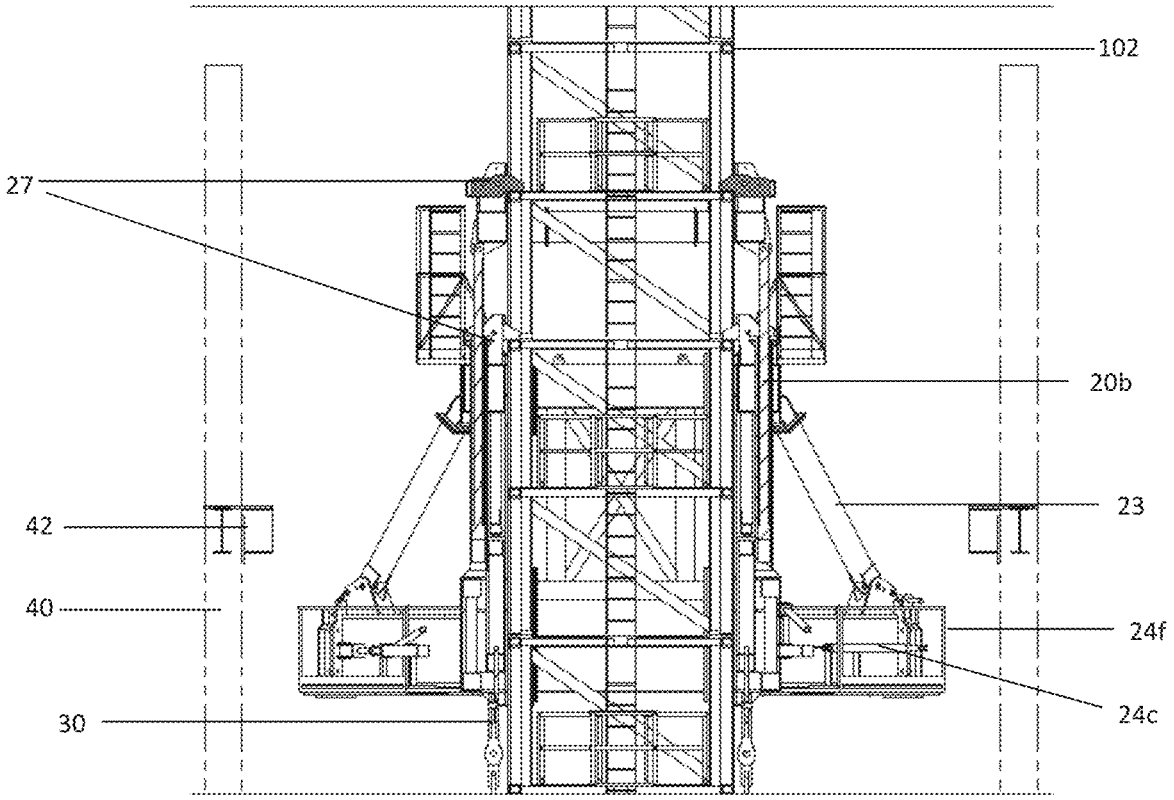
FIG. 16*b* shows a view of the support platform repositioning to enable a further tower crane repositioning step, in accordance to an embodiment of the present invention.

With reference to FIGS. 16*a* and 16*b*, the supporting platform (20) is repositionable along the tower (102) by rotating the plurality of support hooks of the first section (22) to disconnect the plurality of support hooks (27) from the tower (102), extending the second lifting means (28) to extend (20*a*) the supporting platform (20) to reposition the first section (22) at a desired height, reconnecting the plurality of support hooks of the first section (22) to the tower (102), disconnecting the plurality of support hooks (27) of the second section (23), and retracting the second lifting means (28) to retract the supporting platform (20) to reposition the second section (23), thereby repositioning the supporting platform (20). Prior to the repositioning of the supporting platform (20), it is preferred for the outrigger arms (24) to be retracted (24*f*), in order to provide path for the supporting platform (20) to move.

The repositioning of the supporting platform (20) may be performed whenever there is a need to adjust the position of the ladder (30). By repositioning the ladder (30), the main platform (10) is provided with more reach, thereby allowing the main platform (10) to reposition the tower (102) with more flexibility, thereby allowing the tower (102) crane (101) to be elevated higher.

Preferably, the main platform (10), the supporting platform (20), and the lateral supporting means (the outrigger arms) (24, 15) are made with modular configuration. This allows faster installation of the system (100) as well as efficient dismantling of the system (100), when a need to do so arises. The modularity of the system (100) further reduces the need to preassembling the main platform (10), supporting platform (20), and the lateral supporting means (24, 15), thereby providing more efficient logistics as components of the system (100) may be transported in parts to improve transportability of the system (100), as well as increasing efficiency in assembling the system (100) to the tower (102) crane (101) at the building construction site.

Figure 17A:
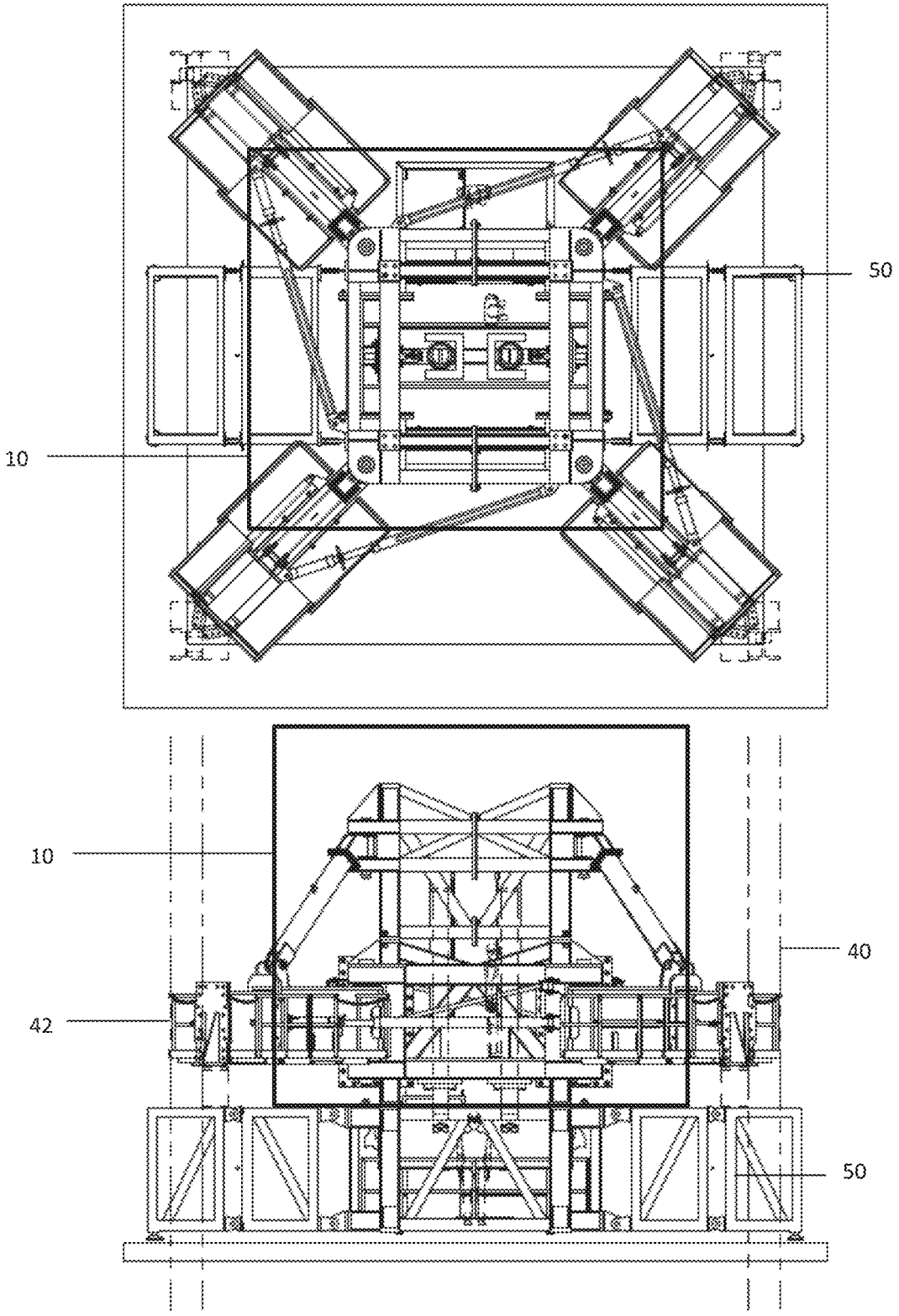
FIG. 17*a* shows a top view and a side view of the dismantling structure, in accordance to an embodiment of the present invention.
Figure 17B:
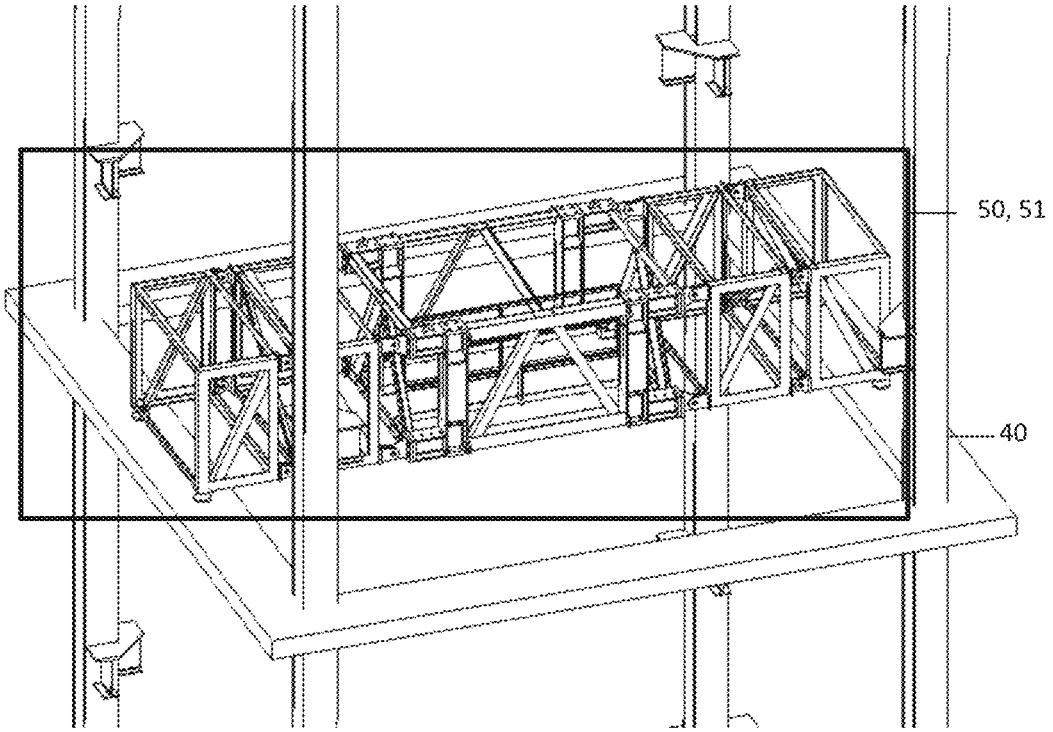
FIG. 17*b* shows a perspective view of the dismantling structure, in accordance to an embodiment of the present invention.

With reference to FIGS. 17*a* and 17*b*, the system (100) further comprises a dismantling structure (50) employable to the main platform (10) to facilitate dismantling of the main platform (10). The dismantling structure (50) is preferably configured in a bridge configuration (51), allowing the dismantling structure (50) to be positioned from one end of the supporting structure (40) to another end of the supporting structure (40) to support the loads of the main platform (10) during the dismantling process.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language).

While this invention has been particularly shown and described with reference to the exemplary embodiments thereof, it will be understood by those skilled in the art that various changes in form and details may be made therein without departing from the scope of the invention as defined by the appended claims.

The invention claimed is:

1. A system for repositioning at least one crane superposed on a tower positioned within a bay of a building structure surrounded by a supporting structure having a plurality of repositionable support brackets, comprising:

at least one supporting platform reversibly mounted to the tower by a plurality of support hooks;

a ladder vertically suspended from the supporting platform adapted as a track; and a main platform adapted to carry and reposition the tower comprises at least one first lifting means configured to reversibly extend the main platform, at least a first climbing means and a second climbing means reversibly engageable to the ladder, wherein the main platform is configured to reposition the crane by engaging the first climbing means to the climbing ladder, extending the main platform with the first lifting means, engaging the second climbing means to the ladder, disengaging the first climbing means from the climbing ladder, and retracting the main platform by the first lifting means, consequently repositioning the tower along the climbing ladder to reposition the at least one crane.

2. The system as claimed in claim 1, wherein either the main platform or both the main platform and the supporting platform further comprising a lateral supporting means.

3. The system as claimed in claim 2, wherein the lateral supporting means comprises a plurality of outrigger arms extending from the main platform or the main platform and the supporting platform adapted to reversibly connect to the supporting structure.

4. The system as claimed in claim 3, wherein the outrigger arms are retractable.

5. The system as claimed in 3, wherein the plurality of outrigger arms are rotatable with respect to the main platform or the main platform and the supporting platform.

6. The system as claimed in claim 3, wherein each of the outrigger arms are connected to the main platform or the main platform and the supporting platform by a pin adapted to be rotatable at an axis with respect to the pin.

7. The system as claimed in claim 6, wherein each of the outrigger arms comprises an outrigger beam extendable from an outrigger housing connected to the main platform or the main platform and the supporting platform by the pin.

8. The system as claimed in claim 7, wherein each of the outrigger arms are configured to be telescopically extendable from the outrigger housing by at least one hydraulic cylinder.

9. The system as claimed in claim 7, wherein each of the outrigger arms further comprises a horizontal brace extending from the main platform or the main platform and the supporting platform to the outrigger housing.

10. The system as claimed in claim 7, wherein each of the outrigger arms further comprises a vertical brace extending from the main platform or the main platform and the supporting platform to the outrigger housing.

11. The system as claimed in claim 7, wherein each of the outrigger arms further comprises a connecting point at an end of the outrigger beam reversibly connectible to the supporting structure by the repositionable support brackets.

12. The system as claimed in claim 3, wherein the outrigger arms are adapted to retract for detaching the outrigger arms from the supporting structure during tower repositioning.

13. The system as claimed in claim 3, wherein the outrigger arms are configured to extend towards the supporting structure to connect the main platform to the supporting structure after repositioning is complete.

14. The system as claimed in claim 3, wherein the lateral supporting means comprises at least three outrigger arms.

15. The system as claimed in claim 3, wherein the outrigger arms are retracted during the repositioning of the supporting platform.

16. The system as claimed in claim 2, wherein outrigger arms of the supporting platform are adapted to be extended and connected to the supporting structure during tower repositioning.

17. The system as claimed in claim 1, wherein the supporting platform comprises a first section and a second section connected by at least one lifting means.

18. The system as claimed in claim 17, wherein the plurality of support hooks are configured to the first section and the second section.

19. The system as claimed in claim 18, wherein the guide comprises at least one adjustable clamp block adapted to be in proximity with the tower during tower repositioning to maintain Z-axis stability of the tower.

20. The system as claimed in claim 17, wherein the first section and the second section are reversibly mounted to the tower by connecting the plurality of support hooks to the tower.

21. The system as claimed in claim 17, wherein the second section comprises a guide to maintain Z-axis stability of the tower during tower repositioning.

22. The system as claimed in claim 17, wherein the supporting platform is repositionable along the tower by rotating the plurality of support hooks of the first section to disconnect the plurality of support hooks from the tower, extending the second lifting means to extend (20*a*) the supporting platform to reposition the first section at a desired height, reconnecting the plurality of support hooks of the first section to the tower, disconnecting the plurality of support hooks of the second section, and retracting the second lifting means to retract the supporting platform to reposition the second section, thereby repositioning the supporting platform.

23. The system as claimed in claim 1, wherein the plurality of support hooks are disconnected from the tower during tower repositioning.

24. The system as claimed in claim 1, wherein the ladder comprises a plurality of rungs.

25. The system as claimed in claim 1, wherein the ladder is rotatable about X and Y axes with respect to the supporting platform.

26. The system as claimed in claim 1, wherein the ladder is attached to the supporting platform by a lug and at least one connector.

27. The system as claimed in claim 1, wherein the main platform further comprising a first assembly and a second assembly connected by the first lifting means.

28. The system as claimed in claim 27, wherein the first assembly is adapted to support the tower during repositioning of the tower.

29. The system as claimed in claim 27, wherein the second assembly is secured to the tower adapted to carry the weight of the tower.

30. The system as claimed in claim 29, wherein outrigger arms are extended from the second assembly adapted to reversibly connect to the supporting structure.

31. The system as claimed in claim 27, wherein the main platform is adapted to extend (10*a*) by extending the first lifting means for elevating the second assembly away from the first assembly or lowering the first assembly away from the second assembly.

32. The system as claimed in claim 27, wherein the main platform is adapted to retract by retracting the first lifting means for elevating the first assembly towards the second assembly or lowering the second assembly and the tower towards the first assembly.

33. The system as claimed in claim 27, wherein the first climbing means comprises a plurality of hooks pivotally connected to the first assembly.

34. The system as claimed in claim 27, wherein the second climbing means comprises a plurality of hooks pivotally connected to the second assembly.

35. The system as claimed in claim 1, wherein the first climbing means is adapted to latch to rungs of the ladder during extension of the main platform.

36. The system as claimed in claim 1, wherein the second climbing means is adapted to latch to rungs of the ladder after the main platform is extended.

37. The system as claimed in claim 1, wherein the first climbing means is configured to unlatch from rungs of the ladder prior to retraction of the main platform by pulling the first assembly towards the second assembly.

38. The system as claimed in claim 1, wherein the extension and retraction of the main platform are configured to be repeatable to reposition the tower to a height along the supporting structure and limited by height of the structural support.

39. The system as claimed in claim 1, wherein the first climbing means and the second climbing means are configured to disconnect from the ladder when repositioning is complete.

40. The system as claimed in claim 1, wherein the plurality of support hooks are reversibly rotatable by a pivot to reversibly hook the supporting platform to the tower.

41. The system as claimed in claim 1, wherein the supporting platform is repositionable along the tower.

42. The system as claimed in claim 1, wherein the supporting platform is configured to be reversibly extendable.

43. The system as claimed in claim 1, wherein the supporting structure, the main platform, and lateral supporting means are modular.

44. The system as claimed in claim 1, wherein the system further comprises a dismantling structure deployable to the main platform and the supporting structure to facilitate dismantling of the main platform.

45. The system as claimed in claim 44, wherein the dismantling structure comprising a truss structure configured in a bridge configuration deployable to the main platform and attachable to the supporting structure to bear the main platform.

* * * * *